US009977380B2

(12) United States Patent
Wauke et al.

(10) Patent No.: US 9,977,380 B2
(45) Date of Patent: May 22, 2018

(54) HEATER FOR FIXING DEVICE

(71) Applicant: ALPS ELECTRIC CO., LTD., Tokyo (JP)

(72) Inventors: Tomoko Wauke, Miyagi-ken (JP); Eihin Setsu, Miyagi-ken (JP); Hirotoshi Terao, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 501 days.

(21) Appl. No.: 14/643,633

(22) Filed: Mar. 10, 2015

(65) Prior Publication Data

US 2015/0264748 A1 Sep. 17, 2015

(30) Foreign Application Priority Data

Mar. 14, 2014 (JP) ..... 2014-052484
Jan. 15, 2015 (JP) ..... 2015-005988

(51) Int. Cl.
*H05B 3/02* (2006.01)
*G03G 15/20* (2006.01)

(52) U.S. Cl.
CPC . *G03G 15/2053* (2013.01); *G03G 2215/2035* (2013.01)

(58) Field of Classification Search
CPC .... H05B 1/0241; H05B 3/265; H05B 3/0095; H05B 1/02; H05B 3/22; H05B 3/00; H05B 3/26; H05B 3/0014; H05B 3/03; H05B 3/06; G03B 15/20; G03B 15/2053; G03B 2215/2016
USPC ..... 219/546
See application file for complete search history.

(56) References Cited

U.S. PATENT DOCUMENTS

2014/0076878 A1* 3/2014 Shimura ..... G03G 15/2042 219/216

FOREIGN PATENT DOCUMENTS

JP 06-250539 9/1994

* cited by examiner

*Primary Examiner* — Brian Jennison
(74) *Attorney, Agent, or Firm* — Brinks Gilson & Lione

(57) ABSTRACT

A heater for a fixing device heats an object to be heated, the object traveling in a first direction. The heater includes a substrate facing the object and extending in a second direction orthogonal to the first direction; a heating body extending on the substrate in the second direction; a first conductor and a second conductor disposed on the substrate to supply power to the heating body; a plurality of first electrodes each connected to the first conductor and configured to supply power to the heating body; and a plurality of second electrodes having a polarity different from that of the first electrodes, each connected to the second conductor, and configured to supply power to the heating body. The first electrodes and the second electrodes are configured to intersect the heating body, alternately arranged in the second direction, and inclined with respect to the first direction.

6 Claims, 6 Drawing Sheets

260
263
261
282
261
260
280
280
263
262
262

D1
D2
D3

HEATER FOR FIXING DEVICE

CLAIM OF PRIORITY

This application claims benefit of priority to Japanese Patent Application No. 2014-052484 filed on Mar. 14, 2014 and Japanese Patent Application No. 2015-005988 filed on Jan. 15, 2015, which is hereby incorporated by reference in its entirety.

BACKGROUND

1. Field of the Disclosure

The present disclosure relates to a heater for a fixing device. The heater is for heating and fixing an image onto a recording material.

2. Description of the Related Art

Japanese Unexamined Patent Application Publication No. 06-250539 discloses a heating apparatus in which a heater heats an object to be heated (hereinafter may simply be referred to as "object") through a heat-resistant film. The heater includes an electric heating body and a plurality of electrodes that supply power to the electric heating body. The electrodes are arranged on the electric heating body in a direction orthogonal to the direction of travel of the object such that different polarities alternate. This configuration can reduce the power supply and current carrying distance. Therefore, even when a material with a high volume resistivity is used, a sufficient amount of heat can be generated and heating can be performed as desired.

In the heating apparatus described in Japanese Unexamined Patent Application Publication No. 06-250539, the electrodes of different polarities are alternately arranged in a comb-like shape. Heating body elements are each formed by a segment of the electric heating body, the segment being interposed between two adjacent electrodes. Each heating body element in an interelectrode region has a high temperature because of heat generated by current flowing from one to the other of the adjacent electrodes. On the other hand, at positions corresponding to the respective electrodes, an increase in the temperature of the electric heating body is smaller than that in the interelectrode regions. This means that in the electric heating body, there is a temperature difference between the interelectrode regions and the positions corresponding to the electrodes. Since the electrodes are arranged in the direction orthogonal to the direction of travel of the object, the electric heating body has streaks of low-temperature portions at the positions corresponding to the electrodes, along the direction of travel of the object. This leads to an uneven distribution of heat applied to the object.

SUMMARY

A heater for a fixing device is configured to heat an object to be heated, the object traveling in a first direction. The heater includes a heating body facing the object and extending on a substrate in a second direction orthogonal to the first direction; a first conductor and a second conductor disposed on the substrate to supply power to the heating body; a plurality of first electrodes each connected to the first conductor. The first electrodes are configured to supply power to the heating body. A plurality of second electrodes have a polarity different from that of the first electrodes and each connected to the second conductor. The second electrodes are configured to supply power to the heating body. The first electrodes and the second electrodes are configured to intersect the heating body, alternately arranged in the second direction, and inclined with respect to the first direction.

The first direction refers to a direction in which the object is conveyed. The second direction refers to a direction orthogonal to the direction in which the object is conveyed. The second direction is along the longitudinal direction of the substrate facing the object.

The angle of inclination of the first and second electrodes with respect to the first direction exceeds 0 degrees. This angle of inclination is not 90 degrees, because the first and second electrodes intersect the heating body and are alternately arranged in the second direction.

As described above, the electrodes are inclined with respect to the direction in which the object is conveyed (first direction). It is thus possible, in the second direction (longitudinal direction of the heating body having a long plate-like shape), to reduce unevenness in the distribution of heat applied to the object.

In the heater according to the aspect of the present invention, a length of a diagonal line of each heating-body element surface interposed between adjacent first and second electrodes is preferably longer than a length of sides of the heating-body element surface, the sides extending in the second direction. The heating-body element surface refers to a surface of a region interposed between adjacent first and second electrodes on the surface of the heating body. The heating-body element surface is surrounded by four sides, including two sides along the second direction and the first and second electrodes.

With this configuration, it is possible to reduce imbalance in the distribution of current in the heating-body element surface, and thus to reduce unevenness in the distribution of heat applied to the object in the second direction.

DESCRIPTION OF THE EXEMPLARY EMBODIMENTS

A heater for a fixing device according to an embodiment of the present invention will now be described in detail with reference to the drawings. The heater can be used in an image forming apparatus, such as a copier, a printer, a fax machine, or a multifunction peripheral. Specifically, the heater is used in the process of heating and fixing a toner image formed by an image forming process, such as the process of electrophotography, electrostatic recording, or magnetic recording, onto a recording material which is an object to be heated. Examples of the recording material include a print sheet, an electrofax sheet, an electrostatic recording sheet, and a transfer sheet. The heating and fixing process using the heater may involve heating a toner image formed on a recording material, or may involve heating a toner image formed on an intermediate transfer material to transfer it onto a recording material. Examples of the intermediate transfer material include a belt, a film, and a drum.

As an example, the embodiment described below deals with a fixing device in which a toner image formed on a recording material is heated, through a heat-resistant belt, by a heater for the fixing device and fixed onto the recording material. A heater for a fixed device according to the present invention is not limited to this.

Figure 1:
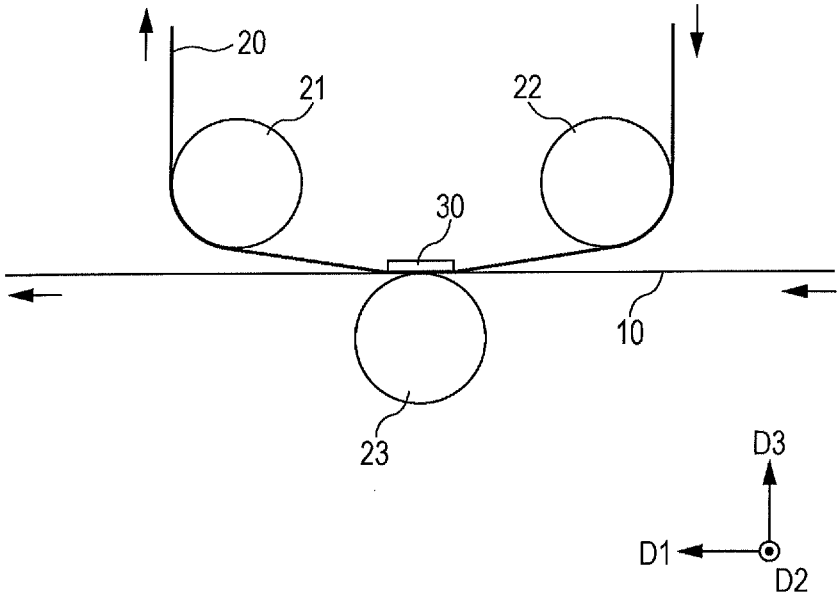
FIG. 1 is a lateral view illustrating a configuration of part of an image forming apparatus that includes a fixing device equipped with a heater for the fixing device according to an embodiment of the present invention.
Figure 2A:
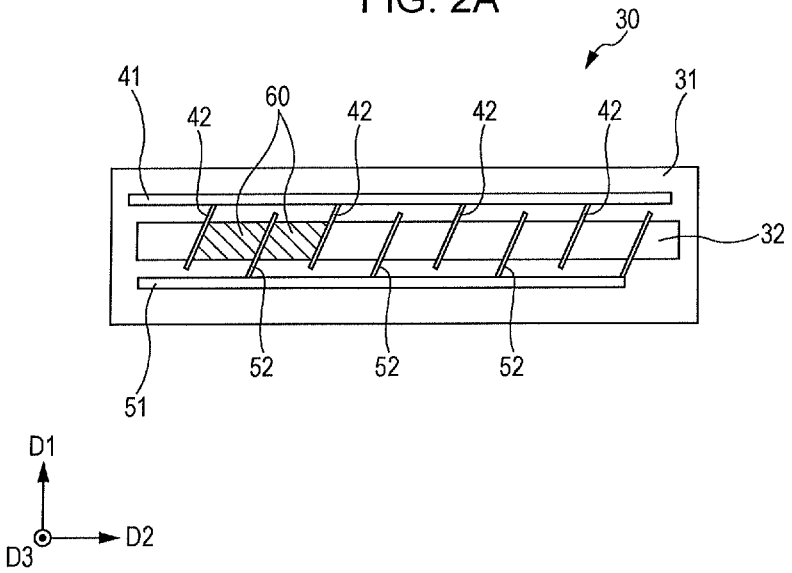
FIG. 2A is a plan view illustrating a configuration of the heater according to the embodiment.
Figure 2B:
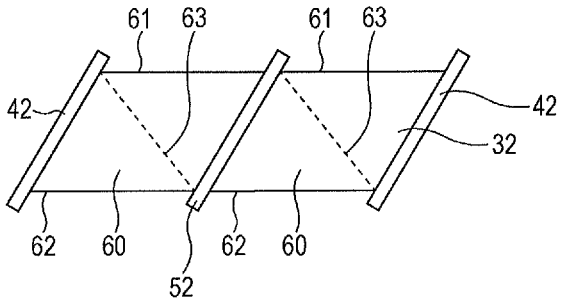
FIG. 2B is an enlarged view of part of the heater illustrated in FIG. 2A.

FIG. 1 is a lateral view illustrating a configuration of part of an image forming apparatus that includes a fixing device equipped with a heater 30 for the fixing device according to the present embodiment. FIG. 2A is a plan view illustrating a configuration of the heater 30, and FIG. 2B is an enlarged view of part of the heater 30 illustrated in FIG. 2A.

As illustrated in FIG. 1, the fixing device is positioned such that a belt 20 wound around rollers 21 and 22 is in contact with a recording material 10 under a constant pressure. The recording material 10, which is an object to be heated, has a toner image thereon formed by an image forming unit (not shown). The recording material 10 is conveyed by a conveying unit (not shown) in a first direction D1 (conveying direction).

The fixing device includes the heater 30 and an elastic pressure roller 23. The heater 30 is disposed with its lower surface facing the upper surface of the recording material 10. The heater 30 extends in a second direction D2 orthogonal to the conveying direction (first direction) D1. As illustrated in FIG. 2A, the heater 30 includes a substrate 31, a heating body 32, a first conductor 41, first electrodes 42, a second conductor 51, and second electrodes 52. The heater 30 further includes a power supply (not shown) and a circuit (not shown) for energizing the first electrodes 42 and the second electrodes 52 and controlling the energization. As illustrated in FIG. 1, the heater 30 and the pressure roller 23 face each other, with the recording material 10 and the belt 20 interposed therebetween, in a third direction D3 orthogonal to the first direction D1 and the second direction D2.

The substrate 31 is a long plate-like member facing the recording material 10 which is an object to be heated. The substrate 31 is disposed with its longitudinal direction extending in the second direction D2. The substrate 31 is preferably made of a heat-resistant insulating material. For example, AlN or $Al_2O_3$ is used to form the substrate 31.

The heating body 32 is formed on the substrate 31 to extend in the second direction D2. The heating body 32 is preferably made of a resistive material. For example, a conductive material obtained by mixing ruthenium oxide ($RuO_2$) into glass, such as borosilicate glass, is used to form the heating body 32. The heating body 32 is preferably formed by a single row of material extending in the second direction D2, with the electrodes each extending across the heating body 32. The electrodes may be disposed on either the upper or lower surface of the heating body 32.

The first conductor 41 and the second conductor 51 are disposed on the substrate 31 to supply power to the heating body 32. The first conductor 41 and the second conductor 51 are made of a conductive material, such as Ag, Au, or Pt, and are disposed outside the heating body 32 in the first direction D1.

The first electrodes 42 are each connected to the first conductor 41 and are arranged at predetermined intervals in the second direction D2. The second electrodes 52 having a polarity different from that of the first electrodes 42 are each connected to the second conductor 51 and are arranged at predetermined intervals in the second direction D2. The first electrodes 42 and the second electrodes 52 intersect the heating body 32 and are alternately arranged in a comb-like shape in the second direction D2. The first electrodes 42 and the second electrodes 52 are inclined with respect to the first direction D1 and extend across the heating body 32. The angles of inclination of the first electrodes 42 and the second electrodes 52 with respect to the first direction D1 are preferably the same, and exceed 0 degrees. Since the first electrodes 42 and the second electrodes 52 intersect the heating body 32 extending in the second direction D2, their angles of inclination with respect to the first direction D1 are not 90 degrees.

The heating body 32, the first conductor 41, the first electrodes 42, the second conductor 51, and the second electrodes 52 are formed on the substrate 31 by, for example, screen printing.

The configuration described above defines a path that extends from the circuit (not shown) through the first conductor 41 and the first electrodes 42 to the heating body 32, and also a path that extends from the circuit (not shown) through the second conductor 51 and the second electrodes 52 to the heating body 32. Thus, as illustrated in FIG. 2A, the heating body 32 has a plurality of heating-body element surfaces 60 arranged in the second direction D2 and each interposed between adjacent first and second electrodes 42 and 52. The paths described above allow power to be supplied from the circuit to each of the heating-body element surfaces 60.

Between the heater 30 and the pressure roller 23 (see FIG. 1), the belt 20 and the recording material 10 are moved while being kept in intimate contact with each other by a constant force. At the same time, the heating body 32 is heated by energizing the first electrodes 42 and the second electrodes 52 of the heater 30. Thus, the toner image on the recording material 10 is fixed onto the recording material 10 by heat from the heater 30 and pressure from the pressure roller 23 or the heater 30.

As illustrated in FIGS. 2A and 2B, the heating-body element surfaces 60 are each substantially parallelogrammic in plan view. As illustrated in FIG. 2B, the length of a diagonal line 63 of each heating-body element surface 60 interposed between adjacent first and second electrodes 42 and 52 is longer than the length of two sides 61 and 62 of the heating-body element surface 60 along the second direction D2. With this configuration, it is possible to reduce imbalance in the distribution of current in the heating-body element surface 60, and to reduce unevenness in the distribution of heat applied to the recording material 10 in the second direction D2.

Figure 3:
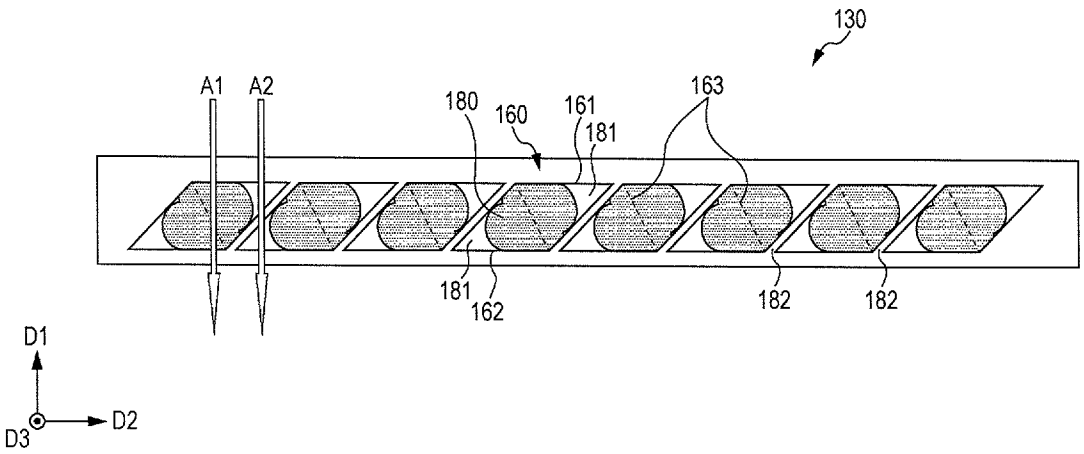
FIG. 3 is a simplified plan view of a heating temperature distribution of a heater for a fixing device in which the length of a diagonal line of each heating-body element surface interposed between adjacent first and second electrodes is shorter than the length of two sides of the heating-body element surface along a second direction.

FIG. 3 is a simplified plan view of a heating temperature distribution of a heater for a fixing device in which the length of a diagonal line of each heating-body element surface interposed between adjacent first and second electrodes is shorter than the length of two sides of the heating-body element surface along the second direction D2. In a heater 130 for a fixing device illustrated in FIG. 3, a relationship between the length of a diagonal line 163 of each heating-body element surface 160 and the length of two sides 161 and 162 of the heating-body element surface 160 along the second direction D2 is different from that in FIG. 2B. In a heating body of the heater 130, a large amount of current flows in regions where the interelectrode distance is short, and a large amount of heat is generated in these regions. Therefore, the temperature of each heating-body element surface 160 is higher in the region having a large amount of heat generation and decreases toward its surrounding areas. As illustrated in FIG. 3, when the length of the two sides 161 and 162 along the second direction D2 is longer than that of the diagonal line 163 in each heating-body element surface 160, the density of current flowing in the heating-body element surface 160 tends to be higher in a region 180 where the interelectrode distance is short. Therefore, the temperature in surrounding areas 181 outside the region 180 is hard to rise. This creates a low-temperature region at each boundary portion 182 between adjacent heating-body element surfaces 160. This means that the temperature is high on an arrow A1 (see FIG. 3) passing through the region 180, but is low on an arrow A2 passing through the surrounding areas 181 and the boundary portion 182. Thus, the temperature of the belt 20 and the recording material 10 rises at a portion passing over the arrow A1, but does not rise at a portion passing over the arrow A2. This causes temperature variation of the belt 20 and the recording material 10 in the width direction (second direction D2).

Figures 4A, 4B, 4C, 4D, 4E:
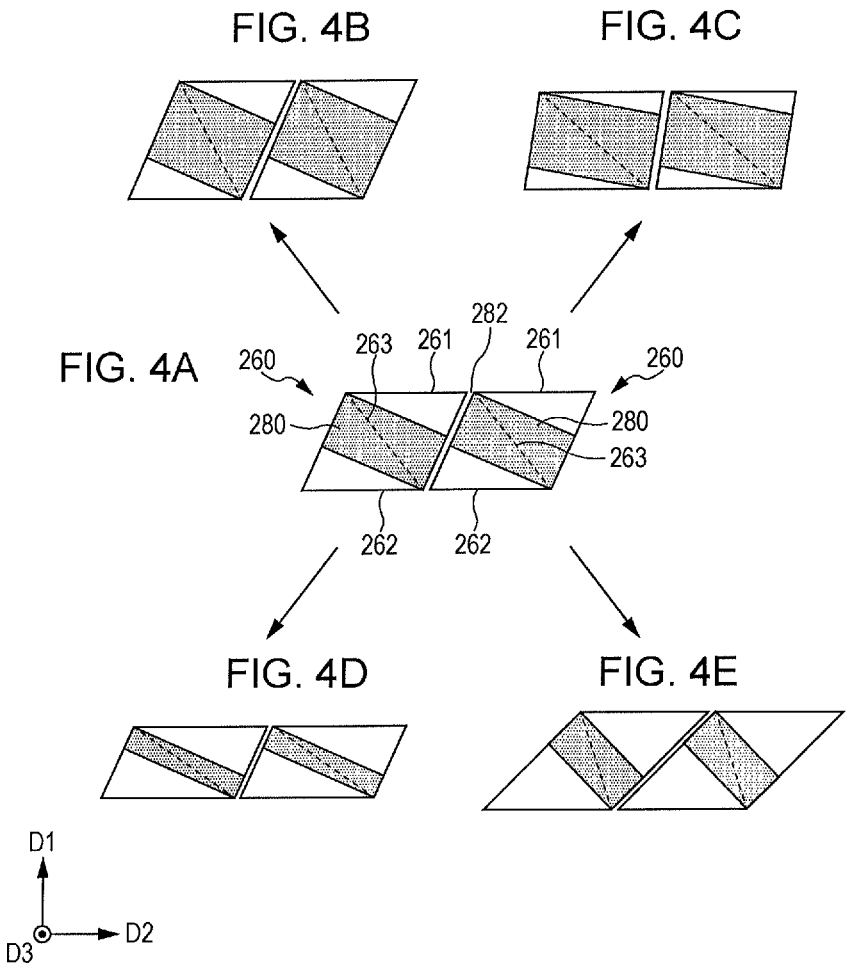
FIGS. 4A to 4E are each a simplified diagram illustrating how a relationship between the length of a diagonal line and the length of two sides along the second direction corresponds to a heat generating state in each heating-body element surface.

FIGS. 4A to 4E are each a simplified diagram illustrating how a relationship between the length of a diagonal line 263 and the length of two sides 261 and 262 along the second direction D2 in each heating-body element surface 260 corresponds to a region where the interelectrode distance is short and a large amount of heat is generated. FIG. 4A illustrates an example where the length of the diagonal line 263 is equal to the length of the two sides 261 and 262, FIG. 4B illustrates an example where the diagonal line 263 is made longer than the two sides 261 and 262 by reducing the aspect ratio, FIG. 4C illustrates an example where the diagonal line 263 is made longer than the two sides 261 and 262 by reducing the angle of inclination of a boundary portion 282 (corresponding to either the first electrode 42 or the second electrode 52), FIG. 4D illustrates an example where the two sides 261 and 262 are made longer than the diagonal line 263 by increasing the aspect ratio, and FIG. 4E illustrates an example where the two sides 261 and 262 are made longer than the diagonal line 263 by increasing the angle of inclination of the boundary portion 282. The comparison of FIGS. 4A to 4E shows that by making the diagonal line 263 longer than the two sides 261 and 262 as in FIGS. 4B and 4C, a region 280 where a large amount of heat is generated occupies a larger area in the heating-body element surface 260. Current in the heating-body element surface 260 flows both inside and outside the region 280. However, when the two sides 261 and 262 are made longer than the diagonal line 263 as in FIGS. 4D and 4E, the region 280 where a large amount of heat is generated is narrowed in the heating-body element surface 260. At the same time, the temperature in the areas outside the region 280 becomes harder to rise. Thus, since the temperature in the region near the boundary portion 282 along the first direction D1 (FIGS. 4D and 4E) does not rise, the temperature of a part of the belt 20 and the recording material 10 passing through this region does not rise and this causes temperature variation in the width direction.

Figure 5:
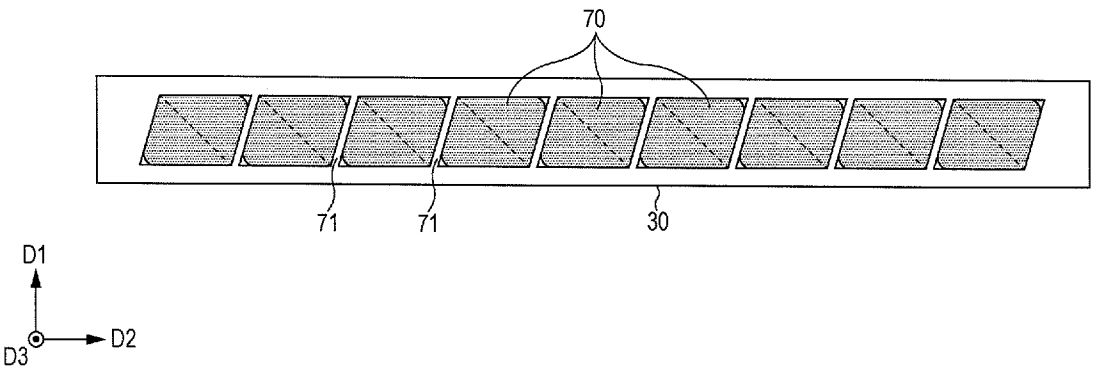
FIG. 5 is a simplified plan view of a heating temperature distribution of the heater according to the embodiment.

FIG. 5 is a simplified plan view of a heating temperature distribution of the heater 30. This temperature distribution represents a state in which the heating body 32 is heated by supplying power from the first electrodes 42 and the second electrodes 52 to the heating body 32. As described above, the length of the diagonal line 63 of each heating-body element surface 60 interposed between adjacent first and second electrodes 42 and 52 is longer than the length of the two sides 61 and 62 of the heating-body element surface 60 along the second direction D2. Therefore, as shown in FIG. 5, the temperature is high throughout most of regions 70 corresponding to the heating-body element surfaces 60, and the temperature in a comb-shaped region 71 corresponding to the first and second electrodes 42 and 52 is lower than that in the regions 70. As described above, the first electrodes 42 and the second electrodes 52 are inclined with respect to the direction of travel (first direction) D1 of the recording material 10. Therefore, when the recording material 10 is heated by the heater 30, every point of the belt 20 or the recording material 10 passes through one of the regions 70 having a high temperature between the heater 30 and the pressure roller 23. Thus, the recording material 10 can be uniformly heated in the width direction (second direction) D2. This can reduce unevenness in the distribution of heat in the second direction D2. Therefore, it is possible to prevent inadequately-fixed portions of the toner image from being left in streaks, and to produce images of consistent quality.

Figure 6A:
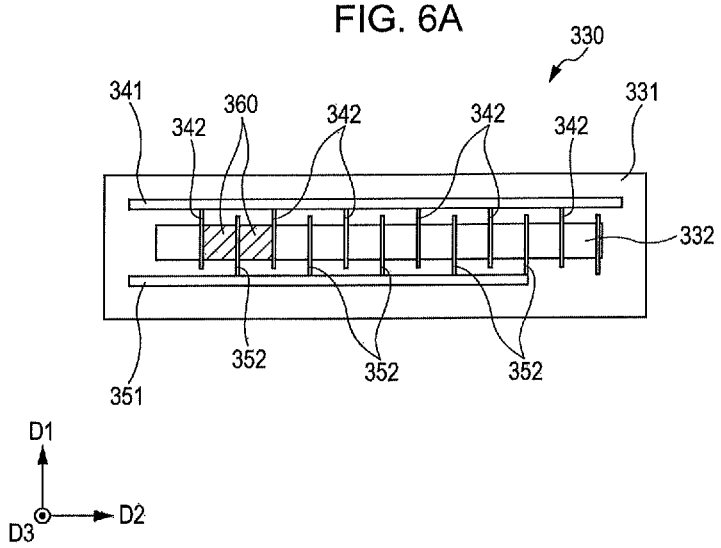
FIG. 6A is a plan view illustrating a configuration of a heater for a fixing device according to a comparative example.
Figure 6B:
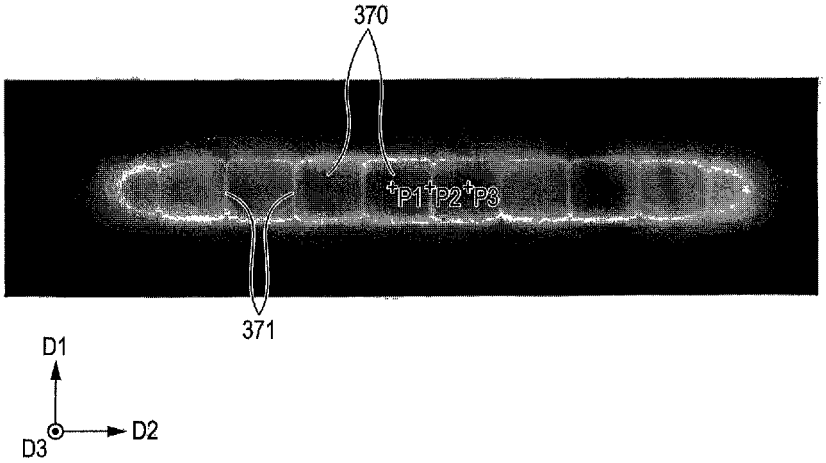
FIG. 6B is a plan view illustrating a heating temperature distribution of the heater according to the comparative example.

FIG. 6A is a plan view illustrating a configuration of a heater 330 for a fixing device according to a comparative example. FIG. 6B is a plan view illustrating a heating temperature distribution of the heater 330. FIG. 6A and FIG. 6B correspond to FIG. 2A and FIG. 5, respectively. The heater 330 is used in the comparative example, instead of the heater 30 in the image forming apparatus illustrated in FIG. 1.

As illustrated in FIG. 6A, the heater 330 includes a substrate 331, a heating body 332, a first conductor 341, first electrodes 342, a second conductor 351, and second electrodes 352. The substrate 331, the heating body 332, the first conductor 341, and the second conductor 351 are not described in detail here, as they are configured in the same manner as the substrate 31, the heating body 32, the first conductor 41, and the second conductor 51 illustrated in FIG. 2A. A power supply (not shown) and a circuit (not shown) for energization and controlling the energization are also the same as those for the heater 30.

The first electrodes 342 are each connected to the first conductor 341 and are arranged at predetermined intervals in the second direction D2. The second electrodes 352 having a polarity different from that of the first electrodes 342 are each connected to the second conductor 351 and are arranged at predetermined intervals in the second direction D2. The first electrodes 342 and the second electrodes 352 intersect the heating body 332 and are alternately arranged in a comb-like shape in the second direction D2. The first electrodes 342 and the second electrodes 352 extend in the first direction D1 across the heating body 332.

The heating body 332 has a plurality of heating-body element surfaces 360 arranged in the second direction D2 and each interposed between adjacent first and second electrodes 342 and 352. As illustrated in FIG. 6A, the heating-body element surfaces 360 are substantially rectangular in plan view.

As illustrated in FIG. 6B, regions 370 corresponding to the heating-body element surfaces 360 have a high temperature, and a comb-shaped region 371 corresponding to the first and second electrodes 342 and 352 has a temperature lower than that in the regions 370. When the recording material 10 is heated by the heater 330, since the direction of travel (first direction) D1 of the recording material 10 coincides with the direction in which the first and second electrodes 342 and 352 extend, the recording material 10 always has a lower temperature at regions corresponding to the comb-shaped region 371 in the width direction (second direction) D2. Since the recording material 10 has portions passing through the regions 370 of high temperature and portions passing through the comb-shaped region 371 of low temperature, there is unevenness in the distribution of heat in the second direction D2. This leads to unevenness in the amount of heat applied to the belt 20 or the recording material 10 in the width direction. As a result, inadequately-fixed portions of the toner image are left in streaks.

In the heater 30 of the embodiment described above, the first and second electrodes 42 and 52 are inclined with respect to the direction of travel (first direction) D1 of the recording material 10. This means that between the heater 30 and the pressure roller 23, every point of the belt 20 or the recording material 10 passes through one of the regions 70 having a high temperature. This can reduce unevenness in the distribution of heat over the recording material 10 in the width direction (second direction) D2, so that the recording material 10 can be heated uniformly. Additionally, in the heater 30, the length of the diagonal line 63 of each heating-body element surface 60 is longer than the two sides 61 and 62 of the heating-body element surface 60 extending in the second direction D2. This can reduce imbalance in the distribution of current in the heating-body element surface 60, and can further reduce unevenness in the distribution of heat applied to the recording material 10 in the second direction D2.

The present invention has been described with reference to the embodiment, but is not limited to this. The present invention can be improved or changed within the purposes of the improvement or the idea of the present invention.

As described above, a heater for a fixing device according to the present invention is useful in performing a heating and fixing process in an image forming apparatus, such as a copier, a printer, a fax machine, or a multifunction peripheral.

What is claimed is:

1. A heater for a fixing device, the heater being configured to heat an object to be heated, the object traveling in a first direction, the heater comprising:

a heating body facing the object and extending on a substrate in a second direction orthogonal to the first direction;

a first conductor and a second conductor disposed on the substrate to supply power to the heating body;

a plurality of first electrodes each connected to the first conductor, the first electrodes being configured to supply power to the heating body; and a plurality of second electrodes having a polarity different from that of the first electrodes and each connected to the second conductor, the second electrodes being configured to supply power to the heating body, wherein the first electrodes and the second electrodes intersect the heating body, alternately arranged in the second direction, and inclined with respect to the first direction, wherein the heating body includes a plurality of heating-body elements, the heating-body elements having heating-body element surface sides with no electrodes such that no power is supplied to the surface sides with no electrodes, and wherein a length of a diagonal line of each heating-body element surface is interposed between adjacent first and second electrodes and the length is longer than a length of the heating-body element surface sides with no electrodes, the sides extending in the second direction, wherein, the first electrodes and the second electrodes are inclined with respect to the first direction and extend across the heating body, wherein the angles of inclination of the first electrodes and the second electrodes with respect to the first direction are the same, and wherein, the heating-body element surfaces are each substantially parallelogrammic in plan view.

2. The heater according to claim 1, wherein the heating body is made of a resistive material.

3. The heater according to claim 2, wherein heating body comprises a single row of material extending in the second direction.

4. The heater according to claim 1, wherein first electrodes are arranged at predetermined intervals in the second direction, the second electrodes have a polarity different from that of the first electrodes and are arranged at predetermined intervals in the second direction.

5. The heater of claim 1, wherein angles of inclination of the first electrodes and the second electrodes with respect to the first direction are greater than 0 degrees.

6. The heater of claim 1, wherein, the first electrodes and the second electrodes intersect the heating body and are alternately arranged in a comb-like shape in the second direction.

* * * * *